US007118405B2

(12) United States Patent
Peng

(10) Patent No.: US 7,118,405 B2
(45) Date of Patent: Oct. 10, 2006

(54) STRUCTURE AND METHOD FOR CONNECTING CONDUCTING LINES TO TERMINALS

(76) Inventor: John Peng, No. 12, Lane 270, Sec. 3, Beishen Rd., Shenkeng Township, Taipei County 222 (TW)

( * ) Notice: Subject to any disclaimer, the term of this patent is extended or adjusted under 35 U.S.C. 154(b) by 0 days.

(21) Appl. No.: 11/026,599

(22) Filed: Dec. 30, 2004

(65) Prior Publication Data

US 2006/0148299 A1 Jul. 6, 2006

(51) Int. Cl.
*H01R 4/24* (2006.01)

(52) U.S. Cl. ..... 439/417

(58) Field of Classification Search ..... 439/417, 439/409, 395, 404, 418, 935, 934
See application file for complete search history.

(56) References Cited

U.S. PATENT DOCUMENTS 4,701,138 A * 10/1987 Key ..... 439/417
4,826,449 A * 5/1989 Debortoli et al. ..... 439/411
5,007,858 A * 4/1991 Daly et al. ..... 439/498
5,624,274 A * 4/1997 Lin ..... 439/417
5,681,182 A * 10/1997 Reichle ..... 439/417
6,213,808 B1 * 4/2001 Whatmore et al. ..... 439/417
6,488,525 B1 * 12/2002 Abel et al. ..... 439/404
6,604,959 B1 * 8/2003 Martin et al. ..... 439/460
6,609,926 B1 * 8/2003 Chen et al. ..... 439/342
6,669,498 B1 * 12/2003 Okita et al. ..... 439/342
2004/0029431 A1 * 2/2004 Comini ..... 439/417

* cited by examiner

*Primary Examiner*—Phuong Dinh
(74) *Attorney, Agent, or Firm*—Bever, Hoffman & Harms, LLP; Patrick T. Bever

(57) ABSTRACT

A connector structure is provided. The connector structure includes a terminal base having plural terminals, a clip device vertically arranged with the terminal base via a positioning piece and including plural conducting lines and a rotating device located on the clip device.

18 Claims, 10 Drawing Sheets

STRUCTURE AND METHOD FOR CONNECTING CONDUCTING LINES TO TERMINALS

FIELD OF THE INVENTION

The present invention relates to the structure of an insulation displacement connector and the stabbing method used thereby, and more particular to an insulation displacement connector with a rotating plate and the stabbing method used thereby.

BACKGROUND OF THE INVENTION

In general, there are plural terminals for being connected to conducting lines in an insulation displacement connector (IDC). The terminals are located in a terminal base, and it is possible that the terminal base is perpendicularly set on a printed circuit board. During the operation, the IDC is usually connected to a network plug via a Keystone Jack.

Please refer to FIG. 1, which shows an insulation displacement connector 10 disclosed in the Taiwan Utility Patent No. 537544. As shown in FIG. 1, the four conducting lines 13, 14, 15 and 16 on the cover 11 would be stabbed by the clips 19 after the cover 11 is rotated around the shaft 18 of the connecting main body 17 to attach to the terminal base 12.

By the insulation displacement connector 10, a traditional specific stabbing device (not shown) would be not necessary for stabbing the conducting lines 13, 14, 15 and 16. Whatever, since the stabbing action is performed by rotating the cover 11 around the shaft 18, the lines 13, 14, 15, and 16 would be stabbed one by one and it is necessary to check the precision of the relevant stabbing depths all the time. Therefore, it is not so convenient. In addition, since an operator has to press the cover 11 so as to rotate the cover 11, it is really laborious.

As above-mentioned, a new insulation displacement connector and the relevant stabbing method used thereby being able to save the relevant labor and increase the stabbing efficiency are really desired.

SUMMARY OF THE INVENTION

In accordance with an aspect of the present invention, a connector structure is provided. The connector structure includes a terminal base having plural terminals and a clip device vertically arranged with the terminal base via a positioning piece and having plural conducting lines.

Preferably, the connector structure is an insulation displacement connector structure.

Preferably, the positioning piece is detachably connected to the terminal base.

Preferably, the plural terminals are connected to the plural conducting lines simultaneously after the clip device is vertically moved from a first place to a second place.

Preferably, the terminal base is located on a connecting body, and the plural terminals include knife-edges for stabbing through the plural conducting lines.

Preferably, the clip device includes an opening for the positioning piece passing therethrough.

Preferably, the positioning piece includes a fastening end, and the terminal base includes a fastening concavity for containing the fastening end.

Preferably, the fastening end is rotated 90 degrees for being fastened to the terminal base.

In accordance with another aspect of the present invention, a connector structure is provided too. The connector structure includes a terminal base having plural terminals, a clip device vertically arranged with the terminal base via a positioning piece and having plural conducting lines and a rotating device located on the clip device.

Preferably, the plural terminals are connected to the plural conducting lines simultaneously after the clip device is moved from a first place to a second place.

Preferably, the clip device is moved from the first place to the second place by rotating the rotating device.

Preferably, the terminal base is located on a connecting body, the rotating device includes a surface for receiving a force provided by a user, and the plural terminals include knife-edges for stabbing through the plural conducting lines.

Preferably, the connector structure is an insulation displacement connector structure.

In accordance with another aspect of the present invention, a method for connecting plural conducting lines and plural terminals is provided. The method includes steps of a) providing a terminal base having the plural terminals, b) providing a clip device vertically arranged with the terminal base via a positioning piece and having the plural conducting lines and a rotating device, and c) operating the rotating device from a first state to a second state so as to move the clip device from a first place to a second place.

Preferably, the clip device is connected to the terminal base and the plural conducting lines are connected to the plural terminals after the step c).

Preferably, the terminal base is located on a receiving body, the rotating device includes a surface for receiving a force provided by a user, and the plural terminals include knife-edges for stabbing through the plural conducting lines.

Preferably, the clip device is capable of sliding on a slide surface of the receiving body.

Preferably, the clip device is vertically moved to the terminal base along the positioning piece in the step c).

Preferably, the rotating device includes an L-shaped section and an arm.

Preferably, the clip device includes plural U-shaped concavities for containing and holding the plural conducting lines.

The above contents and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
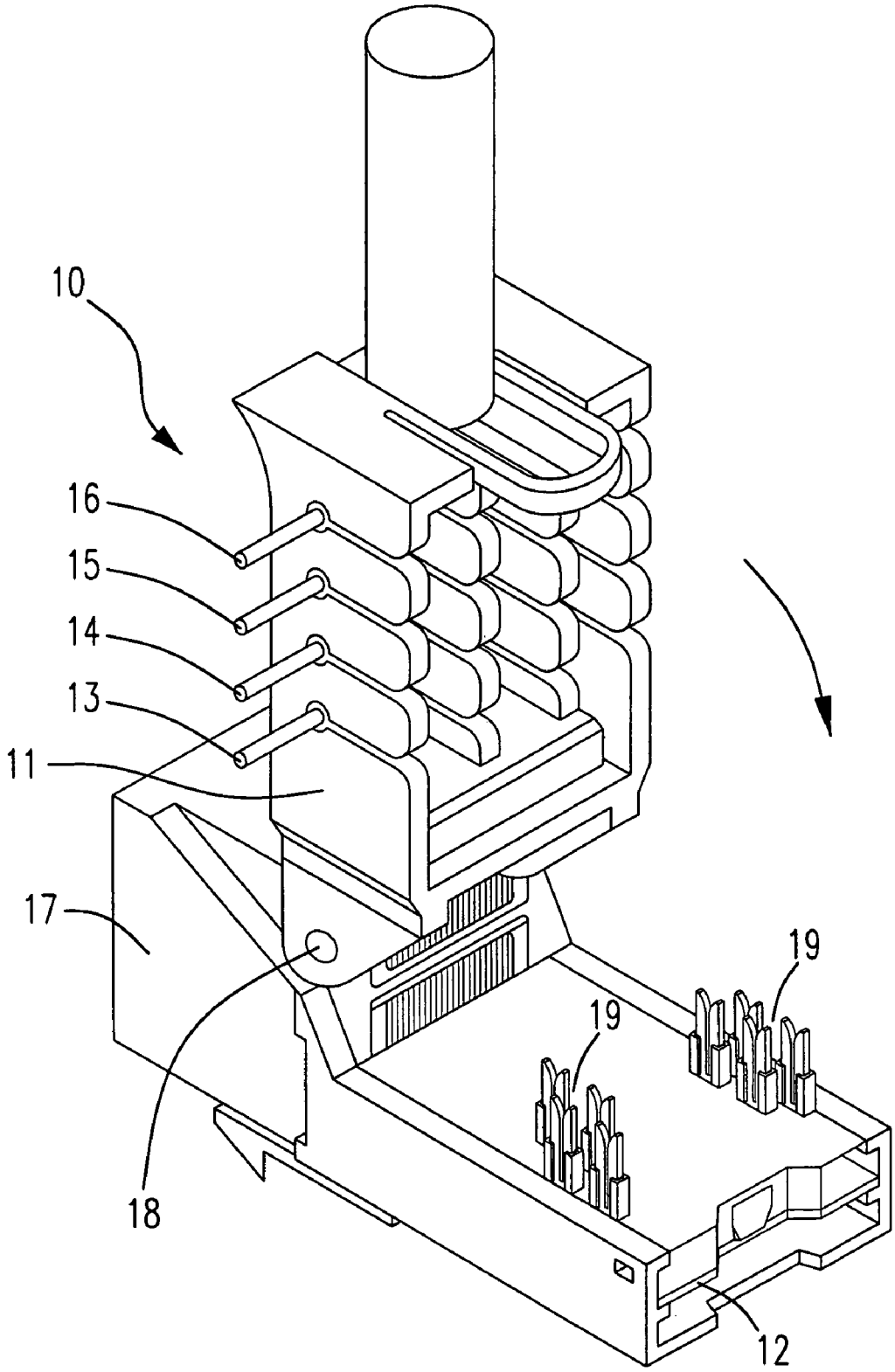
Fig. 1 (PRIOR ART)
FIG. 1 is the schematic view of the insulation displacement connector in the prior art.
Figure 2:
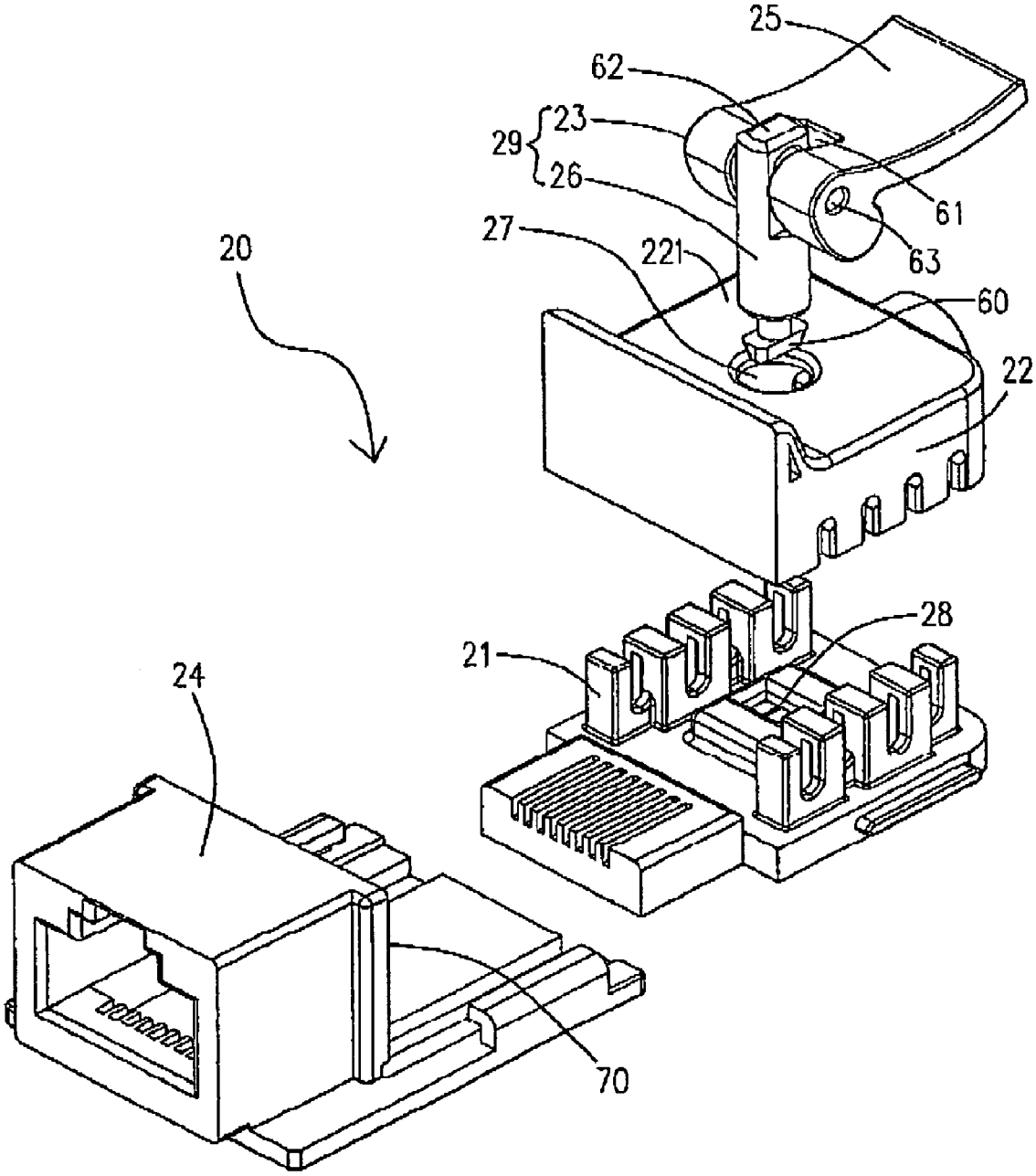
FIG. 2 is an exploding view of an insulation displacement connector according to the preferred embodiment of the present invention.

Please refer to FIG. 2, which shows an exploding view of an insulation displacement connector according to the preferred embodiment of the present invention. As shown in FIG. 2, the insulation displacement connector 20 includes the terminal base 21, the clip 22, and the rotating plate 23, being a pressing handle, the connecting main body 24, the pressing surface 25, the rotating rod 26, the opening 27 formed in an upper wall 221 of the clip 22, and the fastening concavity 28. The concavity 61 of the rotating plate 23 is used for containing the linking end 62 of the rotating rod 26, and the rotating plate 23 is assembled to the rotating rod 26 via the shaft 63 such that the rotating rod 26 and the rotating plate 23 form a positioning piece 29. During the process of assembling, the rotating rod 26 would pass through the opening 27, the fastening end 60 of the rotating rod 26 would pass through the fastening concavity 28 and the terminal base 21 would be connected to the connecting main body 24 via the slide surface 70.

Figure 3:
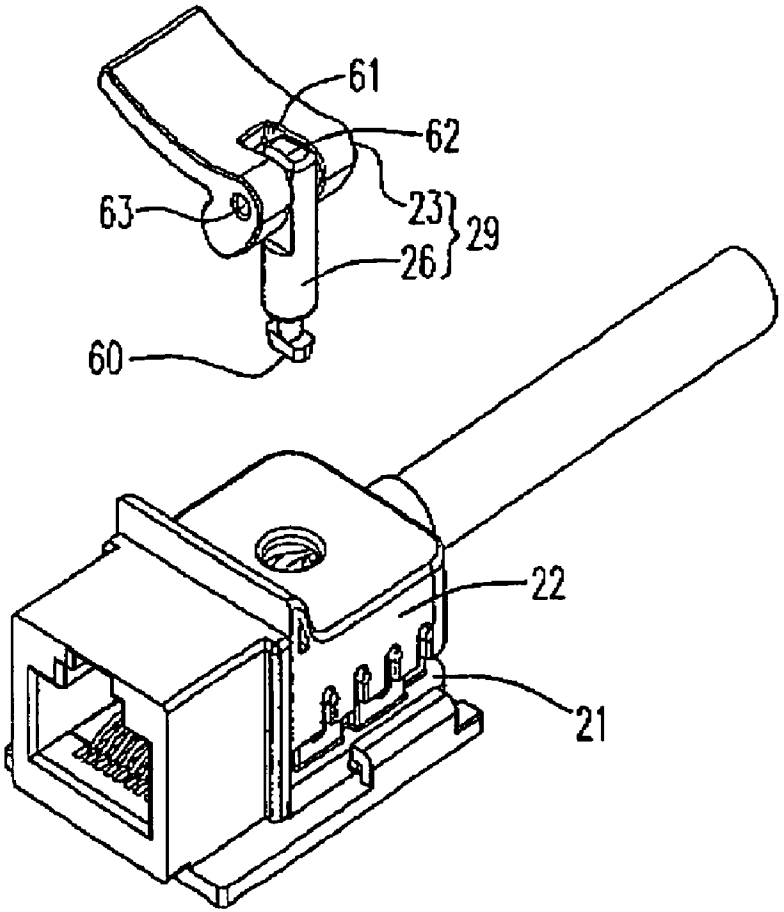
FIG. 3 is the schematic diagram showing the relevant positions among the rotating plate, the rotating rod, the clip and the terminal base according to the preferred embodiment of the present invention.

Please refer to FIG. 3, which is the schematic diagram showing the relevant positions among the rotating plate 23, the rotating rod 26 and the clip 22 according to the preferred embodiment of the present invention. After the positioning piece 29, having the rotating plate 23, and the rotating rod 26, and the clip 22 are assembled together, the positioning piece 29 would be rotated 90 degrees in order to lock the positioning piece 29 to the terminal base 21 via the fastening end 60. The relevant assembly is shown on FIG. 4, which shows the insulation displacement connector 20 according to the preferred embodiment of the present invention.

Please refer to FIG. 3, which is the schematic diagram showing the relevant positions among the rotating plate 23, the rotating rod 26 and the clip 22 according to the preferred embodiment of the present invention. After the rotating plate 23, the rotating rod 26 and the clip 22 are assembled together, the rotating plate 23 and the rotating rod 26 would be rotated 90 degrees for being fastened. The relevant assembly is shown on FIG. 4, which shows the insulation displacement connector 20 according to the preferred embodiment of the present invention.

Figure 5:
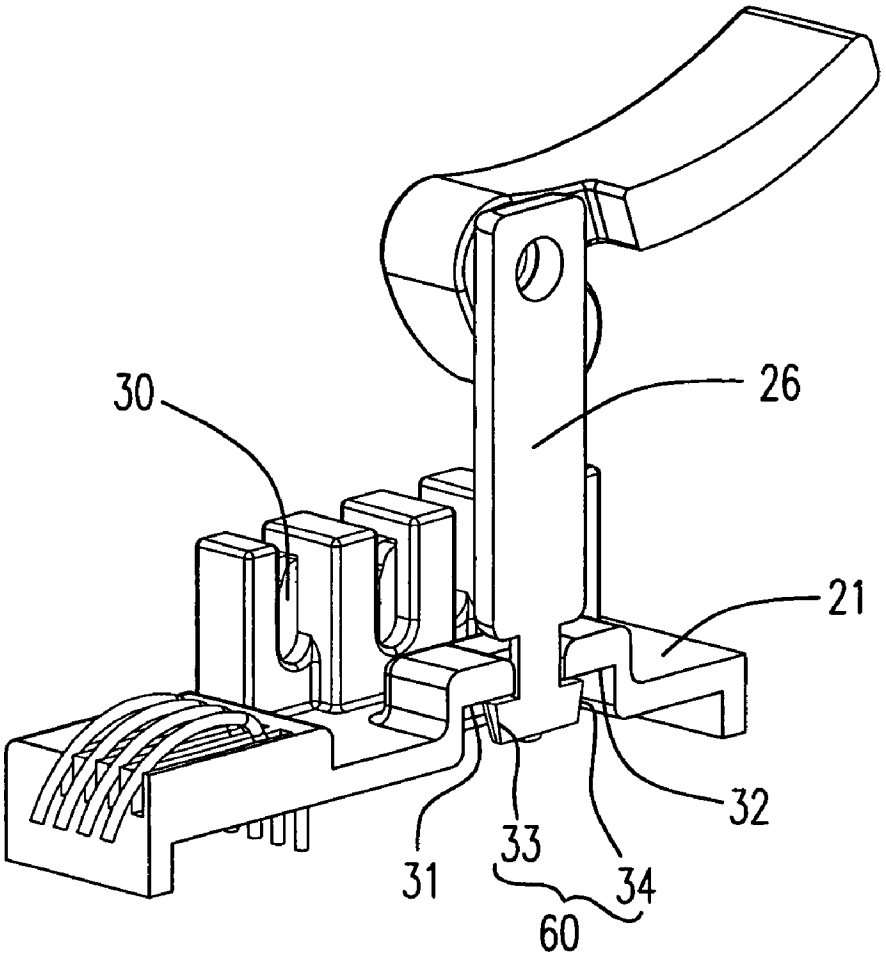
FIG. 5 is a sectional drawing showing the cross-sections of the rotating rod 26 and the terminal base 21 shown in FIG. 2.
Figure 6:
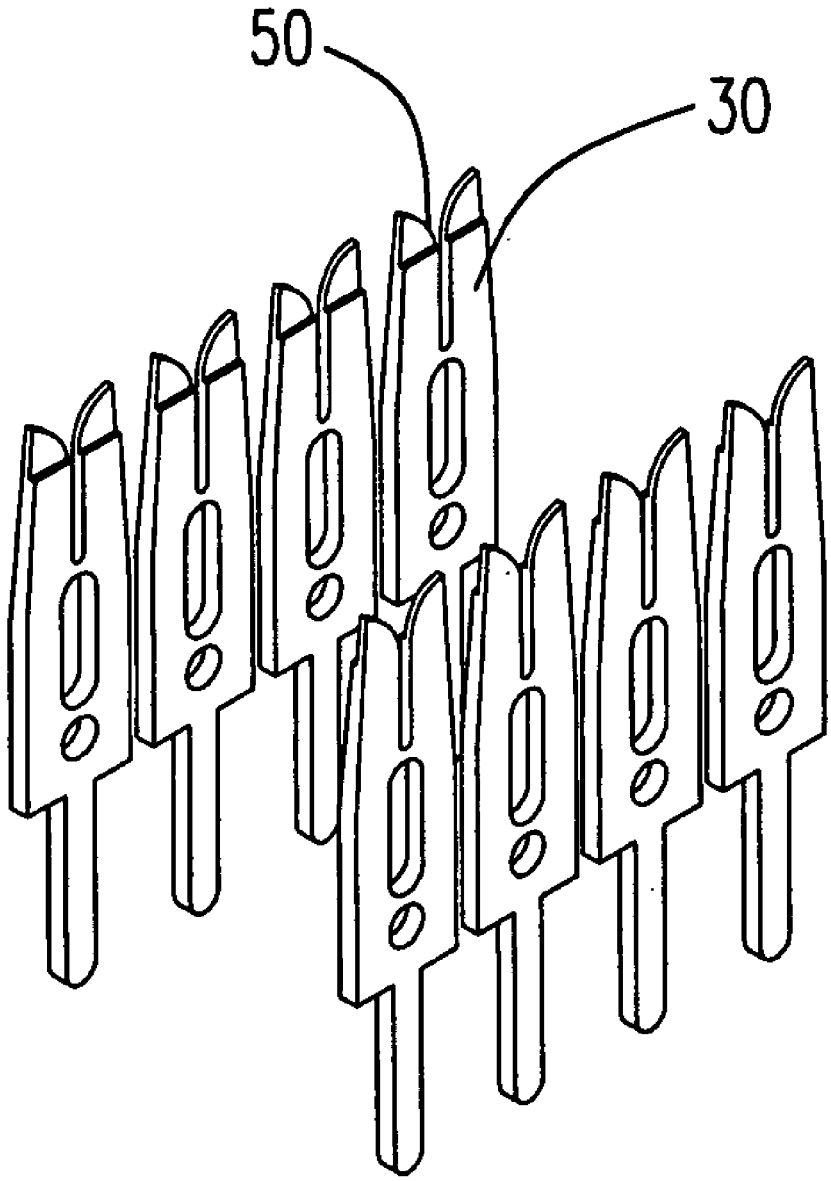
FIG. 6 is the drawing of the terminal 30 shown in FIG. 5.

Please refer to FIG. 5, which is a sectional drawing showing the cross-sections of the rotating rod 26 and the terminal base 21 shown in FIG. 2. As shown in FIG. 5, the terminal base 21 includes the terminal 30, the first propping portion 31 and the second propping portion 32, and the rotating rod 26 includes the fastening end 60 having the first protruding portion 33 and the second protruding portion 34. Please refer to FIG. 6, which is the drawing of the terminal 30 shown in FIG. 5. As shown in FIG. 6, the terminal 30 includes the knife-edges 50.

Figure 4:
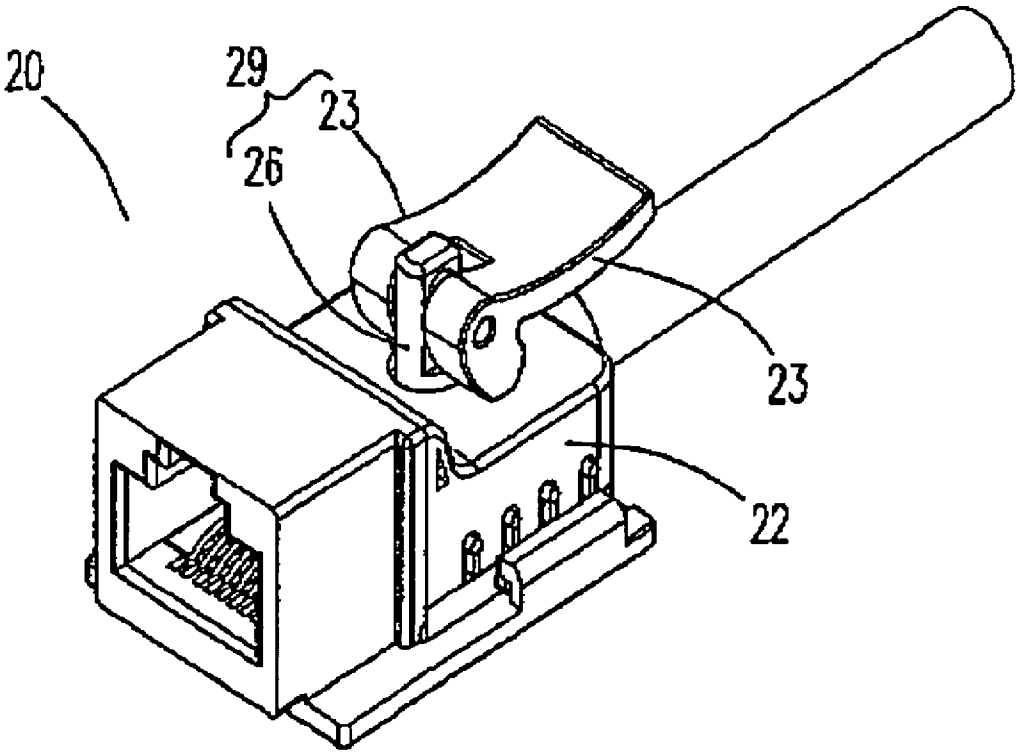
FIG. 4 shows the insulation displacement connector according to the preferred embodiment of the present invention.

Please refer to FIGS. 3 to 5, it should be easily understood that after the fastening end 60 of the rotating rod 26 is inserted through the opening 27 and into the fastening concavity 28 of the terminal base 21 with the rotating rod 26 in the first rotated position shown in FIG. 3, and the rotating plate 23 and the rotating rod 26 are rotated 90 degrees (e.g., from the first rotated position indicated in FIG. 3 to the second rotated position shown in FIG. 4), the first protruding portion 33 and the second protruding portion 34 of the fastening end 60 become buckled (fastened or locked) with the first propping portion 31 and the second propping portion 32, and the rotating rod 26 becomes fastened upon the terminal base 21 accordingly.

Figure 7:
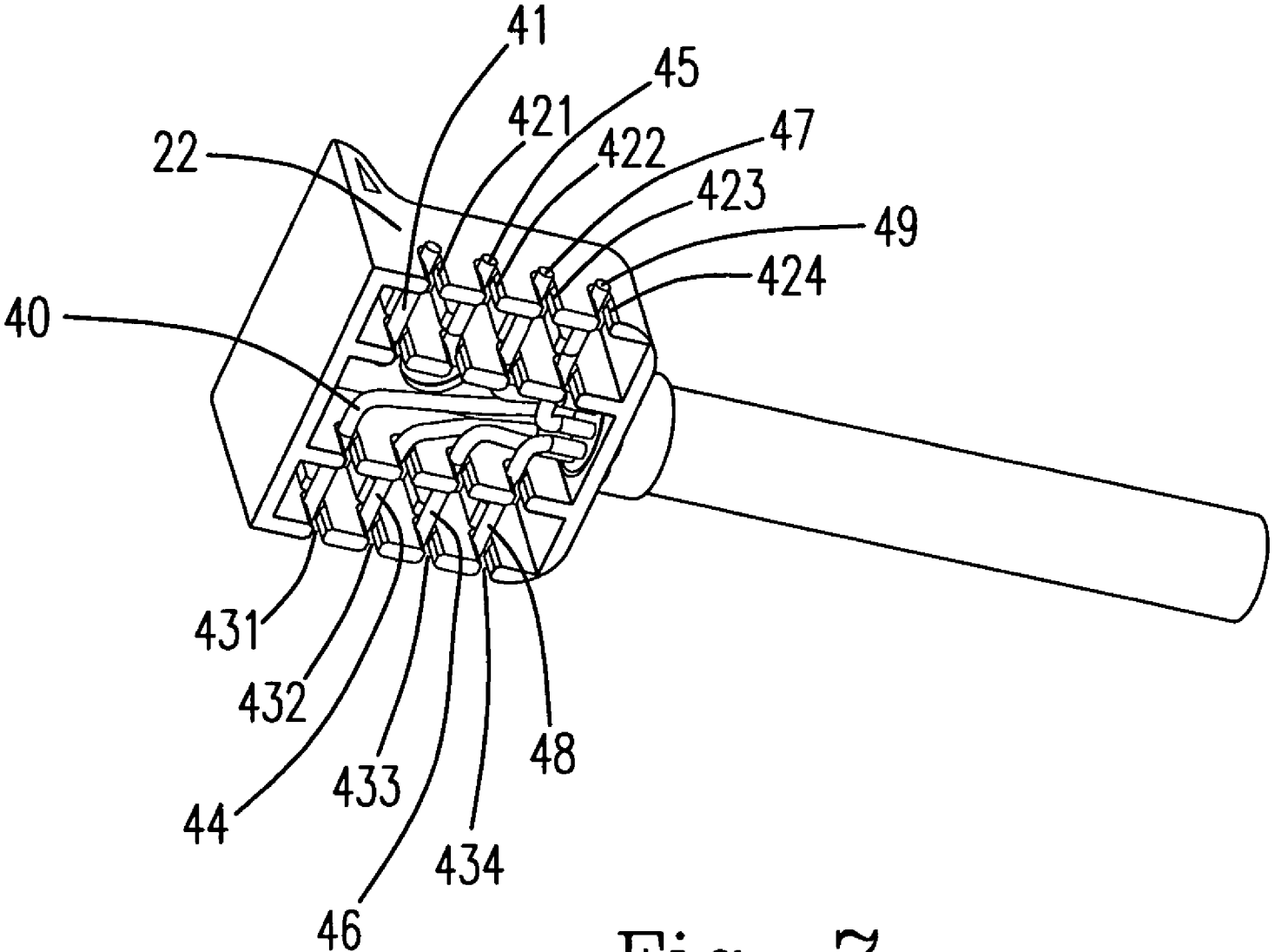
FIG. 7 is a schematic diagram showing the clip containing the plural conducting lines according to the preferred embodiment of the present invention.

Please refer to FIG. 7, which shows the clip 22 containing the plural conducting lines 40, 41, 44, 45, 46, 47, 48 and 49 according to the preferred embodiment of the present invention. As shown in FIG. 7, the clip 22 includes the U-shaped concavities 421, 422, 423, 424, 431, 432, 433 and 434 for containing and holding the conducting lines 41, 45, 47, 49, 40, 44, 46 and 48.

Figure 8:
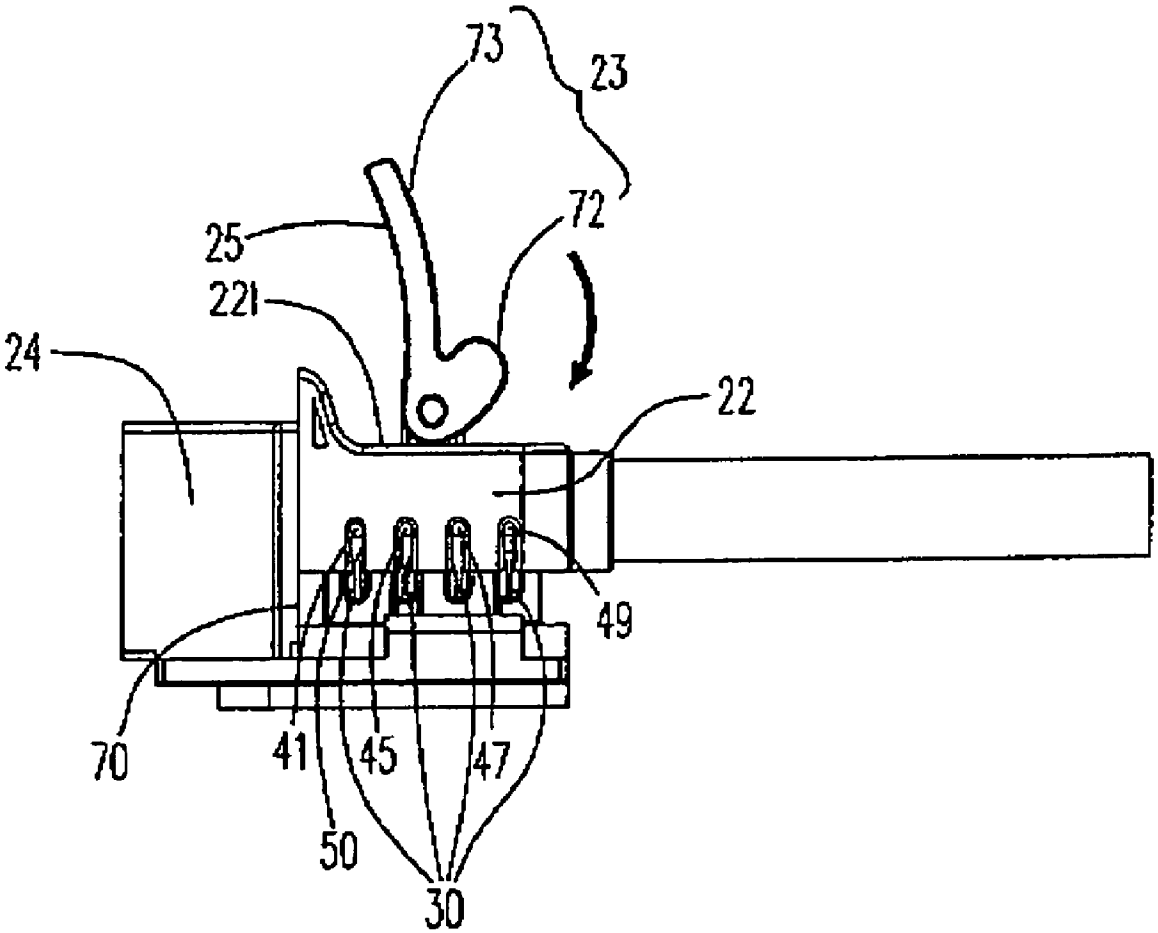
FIGS. 8 and 9 are the schematic diagrams respectively showing the relevant positions among the terminal base, the clip and the connecting main body before and after the rotating plate is operated from a first state to a second state.
Figure 9:
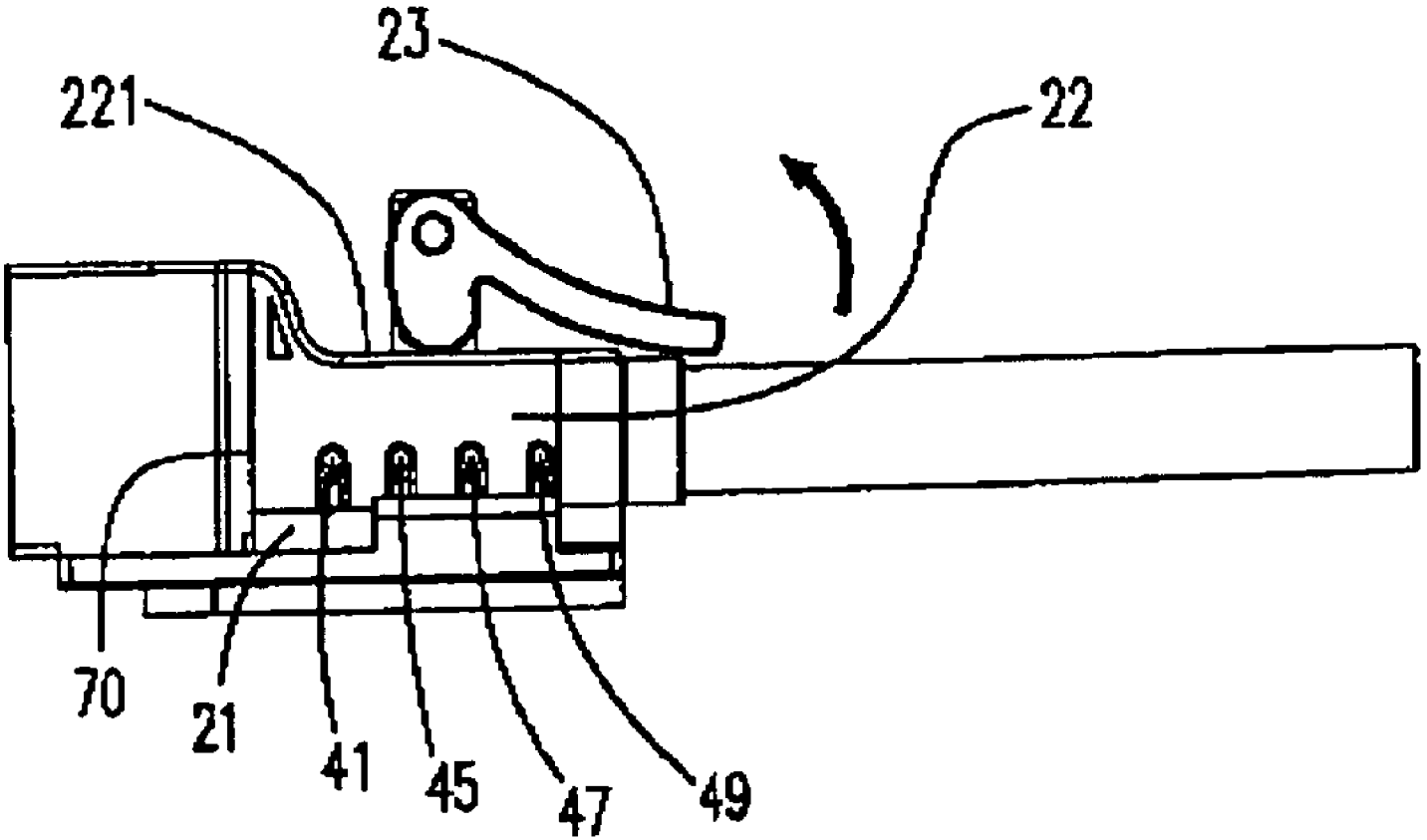

Please refer to FIGS. 8 and 9, which are the schematic diagrams respectively showing the relevant positions among the terminal base 21, the clip 22 and the connecting main body 24 before and after the rotating plate 23 is operated from a first state to a second state. As shown in FIG. 8, the rotating plate (cam member) 23 further includes a long arm 73 and a short arm 72. During the operation, the rotating plate 23 would be rotated from a first state in which short arm 72 is positioned away from upper wall 221 of clip 22, as shown in FIG. 8, to a second state in which short arm 72 is pressed against upper wall 221 of clip 22, as shown in FIG. 9, by pressing the pressing surface 25 such that the rotating plate 23 rotates in the direction of the arrow shown in FIG. 8. Rotation of the pressing surface 25 in this way from the first state to the second state causes the chip 22 to be vertically moved from a raised position (its first place), as shown in FIG. 8, downward to a lowered position (its second place), as shown in FIG. 9, along the slide surface 70, accordingly. However, since the pressing surface 25 is on the long arm 73 of the rotating plate 23 rather than the short arm 72 thereof, the rotation must be a labor-saving action according to the lever principle. In addition, since the chip 22 is vertically moved downward to the terminal base 21 along the slide surface 70 during the relevant operation, the conducting lines 41, 45, 47 and 49 in the clip 22 would be simultaneously connected to the plural terminals 30 in the terminal base 21 and the stabbing depths for the conducting lines 41, 45, 47 and 49 are all the same. In which, the knife-edges 50 of the terminals 30 are used for simultaneously stabbing the conducting lines 41, 45, 47 and 49 when the chip 22 is vertically moved downward to the terminal base 21.

Figure 10:
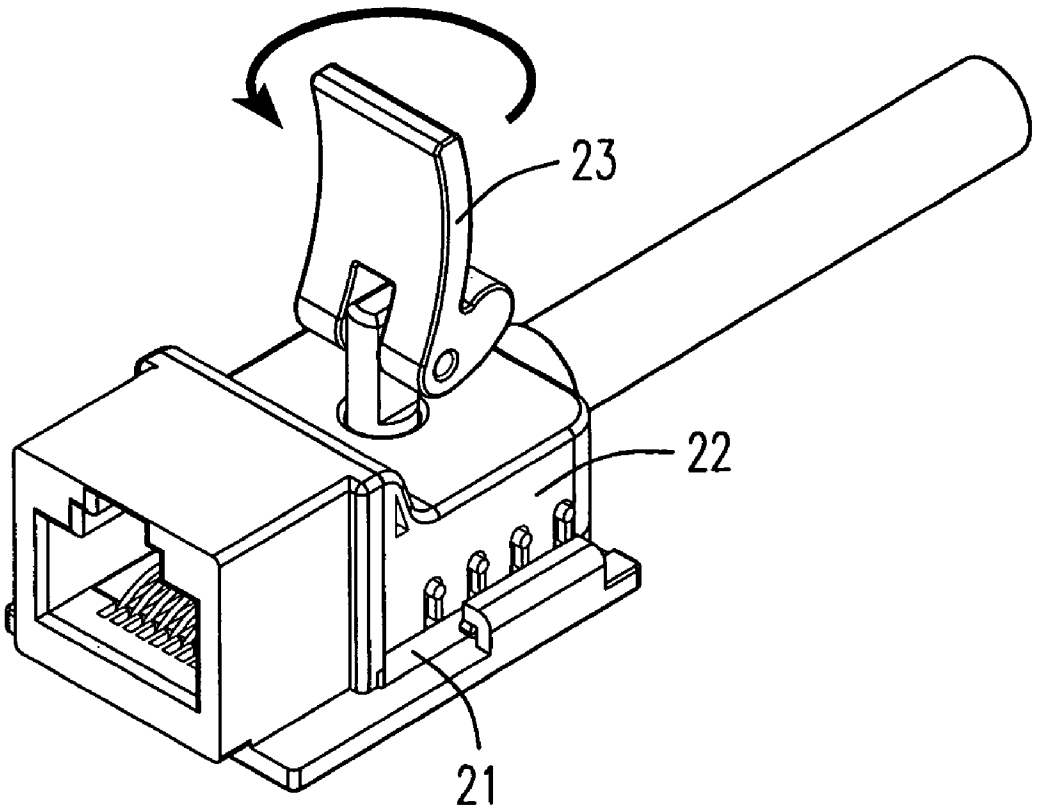
FIG. 10 is the schematic diagram showing how the rotating plate 23 could be removed from the clip.

Please refer to FIG. 10, which is the schematic diagram showing how the rotating plate 23 would be removed from the clip 22.

As shown in FIGS. 8 to 10, after the conducting lines 41, 45, 47 and 49 are connected to the plural terminals 30, the rotating plate 23 would be operated from its second state, shown in FIG. 9, to its first state, shown in FIG. 8, and then rotated 90 degrees and pulled out, wherein the disassembly is performed in a reverse manner as illustrated in FIGS. 3 to 5.

In view of the aforesaid discussions, the present invention provides an insulation displacement connector having a terminal base and a clip vertically arranged with the terminal via a detachable rotating rod. Since the clip would be vertically moved to the terminal base, the plural conducting lines in the clip are able to be connected to the plural terminals in the terminal base simultaneously and the connections between the conducting lines and the terminals are uniform. Since the connections between the conducting lines and the terminals are uniform, the relevant cost for checking each stabbing depth of the plural conducting lines is saved. In addition, since the insulation displacement connector according to the present invention has successfully applied the lever principle, it's indeed a labor-saving connector. As above, the present invention is extremely suitable for being used in the industrial production.

While the invention has been described in terms of what is presently considered to be the most practical and preferred embodiment, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A connector structure, comprising:

a terminal base comprising plural terminals; and a clip device vertically arranged with said terminal base via a positioning piece having a rotating rod with a fastening end, and comprising plural conducting lines, wherein said fastening end of the rotating rod is mounted to said terminal base such that rotation of the rotating rod from a first rotated position to a second rotated position engages the fastening end to said terminal base, and wherein said clip device is vertically movable along the rotating rod between a first place in which the plural conducting lines are displaced from the plural terminals, and a second place in which the plural conducting lines contact the plural terminals wherein said positioning piece further comprises a rotating plate, and said plural terminals are connected to said plural conducting lines simultaneously when said clip device is vertically moved from said first place to said second plate when a user presses said rotating plate.

2. The connector structure according to claim 1, wherein said connector structure is an insulation displacement connector structure.

3. The connector structure according to claim 1, wherein said positioning piece is detachably connected to said terminal base.

4. The connector structure according to claim 1, wherein said terminal base is located on a connecting body, and said plural terminals comprise knife-edges for stabbing through said plural conducting lines.

5. The connector structure according to claim 1, wherein said clip device comprises an opening for said positioning piece passing therethrough.

6. The connector structure according to claim 1, wherein said terminal base comprises a fastening concavity for passing therethrough said fastening end.

7. A connector structure, comprising:

a terminal base comprising plural terminals;

a clip mounted on said terminal base and comprising an upper wall defining an opening, the clip also including a plurality of conducting lines located between the upper wall and the terminal base; and a positioning piece including a rod having a fastening end and a linking end, and a cam member rotatably mounted to said linking end of the rod, wherein the positioning piece is mounted such that the rod is slidably received in the opening of the upper wall of the clip, the fastening end of the rod connected to said terminal base, and the cam member is disposed over the upper wall of the clip, and wherein the cam member is arranged such that when the cam member is rotated from a first state to a second state, the cam member presses the upper wall of the clip toward the terminal base.

8. The connector structure according to claim 7, wherein said plural terminals are connected to said plural conducting lines simultaneously after said clip is moved from a first place when the cam member is in the first state to a second place when the cam member is in the second state.

9. The connector structure according to claim 8, wherein the cam member includes a short arm and a long arm having a pressing surface, and wherein said clip device is moved from said first place to said second place when a user presses said pressing surface such that the short arm is rotated against the upper wall of the clip.

10. The connector structure according to claim 8, wherein said terminal base is located on a connecting body, and said plural terminals comprise knife-edges for stabbing through said plural conducting lines.

11. The connector structure according to claim 8, wherein said connector structure is an insulation displacement connector structure.

12. A method for connecting plural conducting lines and plural terminals, comprising steps of:

a) providing a terminal base having said plural terminals;

b) providing a clip device vertically arranged with said terminal base via a positioning piece having a rotating plate and a rotating rod with a fastening end and having said plural conducting lines; and c) operating said rotating plate from a first state to a second state so as to move said clip device from a first place to a second place along said rotating rod.

13. The method according to claim 12, wherein said clip device is connected to said terminal base and said plural conducting lines are connected to said plural terminals after said step c).

14. The method according to claim 12, wherein said terminal base is located on a receiving body, said rotating plate comprises a surface for receiving a force provided by a user, and said plural terminals comprise knife-edges for stabbing through said plural conducting lines.

15. The method according to claim 14, wherein said clip device is capable of sliding on a slide surface of said receiving body.

16. The method according to claim 12, wherein said clip device is vertically moved to said terminal base along said rotating rod in said step c).

17. The method according to claim 12, wherein said rotating plate comprises two arms.

18. The method according to claim 12, wherein said clip device comprises plural U-shaped concavities for containing and holding said plural conducting lines.

* * * * *